US005129756A

United States Patent [19]

Wheeler

[11] Patent Number: 5,129,756

[45] **Date of Patent: * Jul. 14, 1992**

[54] APPARATUS FOR AND METHOD OF COASTAL EROSION CONTROL USING MASSIVE SEA BLOCK SYSTEM

[76] Inventor: Jack L. Wheeler, 2717 Country Club Rd., Lake Charles, La. 70605

[ * ] Notice: The portion of the term of this patent subsequent to Apr. 11, 2006 has been disclaimed.

[21] Appl. No.: 577,456

[22] Filed: Sep. 4, 1990

Related U.S. Application Data

[63] Continuation-in-part of Ser. No. 335,559, Apr. 10, 1989, Pat. No. 4,954,012, which is a continuation of Ser. No. 77,582, Jul. 24, 1987, Pat. No. 4,820,079.

[51] Int. Cl.[5] ..... E02B 3/06

[52] U.S. Cl. ..... 405/23; 405/31; 405/35; 405/211

[58] Field of Search ..... 405/15, 16, 21, 23, 405/25, 29, 30, 31, 34, 35, 74, 211

[56] References Cited

U.S. PATENT DOCUMENTS

| | | | |
|---|---|---|---|
| 2,014,116 | 9/1935 | Powers | 405/23 |
| 3,393,520 | 7/1968 | Butterworth | 405/21 |
| 3,733,831 | 5/1973 | Sticker | 405/30 |
| 3,957,098 | 5/1976 | Hepworth et al. | 150/9 |
| 3,969,900 | 7/1976 | Plodowski | 405/23 X |
| 4,279,536 | 7/1981 | Jarlan | 405/31 |
| 4,297,052 | 10/1981 | Rankin | 405/16 |
| 4,367,984 | 1/1983 | Cartwright | 405/258 |
| 4,394,924 | 7/1983 | Zaccheroni | 220/19 |
| 4,431,337 | 2/1984 | Iwasa | 405/30 |
| 4,483,640 | 11/1984 | Berger et al. | 405/15 |
| 4,571,121 | 2/1986 | Albert | 405/15 |
| 4,668,123 | 5/1987 | Larsen | 405/15 |
| 4,717,286 | 1/1988 | Loer | 405/74 |
| 4,820,079 | 4/1989 | Wheeler | 405/23 |

FOREIGN PATENT DOCUMENTS

| | | | |
|---|---|---|---|
| 2051933 | 1/1981 | United Kingdom | 405/23 |

*Primary Examiner*—David H. Corbin
*Attorney, Agent, or Firm*—Pravel, Gambrell, Hewitt, Kimball & Krieger

[57] ABSTRACT

An erosion control system that uses massive hollow reinforced concrete blocks that can contain bulky fill material such as sand, mud, shell or concrete rip rap. The blocks can be arranged in desired geometric patterns at coastal areas subject to erosion control.

21 Claims, 4 Drawing Sheets

APPARATUS FOR AND METHOD OF COASTAL EROSION CONTROL USING MASSIVE SEA BLOCK SYSTEM

This is a continuation-in-part application of copending U.S. patent application Ser. No. 07/335,559, filed Apr. 10, 1989, now U.S. Pat. No. 4,954,012 which is a continuation of application Ser. No. 07/077,582, filed Jul. 24, 1987, now U.S. Pat. No. 4,820,079, all incorporated herein by reference.

BACKGROUND OF THE INVENTION

1. Field of the Invention

The present invention relates to coastal erosion control and more particularly relates to a method and apparatus of coastal erosion control wherein an array of hollow reinforced concrete blocks are positioned along vulnerable coastline areas, filled with sand, water, mud, shell, or heavy refuse such as broken concrete or riprap, then sealed after the refuse is added so that the wave action of heavy seas cannot scatter the refuse, and wave action is dissipated.

2. General Background

Stabilization of coastal shorelines has become a major problem in many coastal areas of the country, such as, for example, the Louisiana Gulf Coast area, where many thousands of acres of wetlands are disappearing each year. The shorelines are eroding or disappearing because of a number of reasons, at least one reason being excessive wave action that eats away at the shoreline. Loss of wetlands causes a decrease in habitat for numerous marine species, such as shrimp, crabs, and fish.

Numerous devices have been patented which have attempted to solve the problem of coastal stabilization. The following are examples of U.S. Patents that have been granted for structures that can be placed in a coastal zone or in shallow water for the purpose of stabilizing the shoreline:

| U.S. Pat. No. | Inventor |
|---|---|
| 4,668,123 | Larsen |
| 4,571,121 | Albert |
| 4,483,640 | Berger |
| 4,431,337 | Iwasa |
| 4,367,984 | Cartwright |
| 4,297,052 | Rankin |
| 3,957,098 | Hepworth |

Many of these prior art systems use blocks or structures that are relatively small and that are stacked or placed side-by-side for the purpose of dissipating wave energy. The problem with such small structures is that they are only used where the water interfaces with the shoreline and thus, are of little value in deeper water to break the wave action which pounds at beaches and shorelines. Many of these smaller structures can be moved by very heavy wave action that occurs, for example, during storms such as hurricanes. It is known that hurricanes can greatly erode a shoreline in a matter of a few days when huge wave surges pound at the shoreline and when water levels rise several feet in what is commonly called a tidal surge.

SUMMARY OF THE PRESENT INVENTION

The present invention solves the problem of coastal erosion by providing a very effective barrier to wave action so that waves can be dissipated even during storms, such as hurricanes, where wave action becomes intense. The present invention provides a method of coastal erosion control that includes the steps of transporting a plurality of massive hollow yet transportable reinforced concrete blocks to a coastal site where erosion is to be controlled. The massive blocks are arranged in an array that extends along the erosion site so that the blocks can dissipate wave action. The hollow blocks are filled with refuse material until each block has a massive weight of at least 25 tons. The blocks are then sealed after the fill material refuse is added so that wave action cannot scatter the fill during heavy seas.

Typically the fill material will be sand, water, mud, clay, reef shell or discarded chunks of concrete, large blocks of stone, and/or gravel. In the preferred embodiment, the blocks are generally rectangular having upper and lower flattened surface areas so that the blocks can be stacked. In one embodiment, the block array can be stacked vertically and can extend horizontally so that the array can be used to form jetties in deeper water.

In the preferred embodiment, the blocks are spaced apart a distance so that some water flow can pass between the blocks.

The massive reinforced concrete blocks are preferably hollow having exemplary dimensions of fourteen feet (14') long, eight feet (8') wide, and minimal six feet (6') tall, with a concrete wall thickness of approximately twelve inches (12") minimum. The walls are preferably reinforced with number four (No. 4) diameter steel reinforcing rods spaced twelve inches (12") on center in both directions, and each block is fitted with a plurality of lifting eyes so that the massive blocks can be transported from barges, for example, to the particular site where erosion is to be controlled.

The sea block solution is to place the sea blocks at strategic locations where erosion is taking place. These blocks are arranged in shallow or deep water and arranged in rows or stacked in order to barricade the action of the sea against the shore.

Inside the block, the hollow interior can be sealed using a plastic liner, having a thickness, for example, of twelve mils (0.012") so that any compacted fill material could be sealed within the plastic liner. It should be understood, that the refuse or waste material would normally be material that would be suitable from an environmental standpoint so that there would be no danger to the surrounding environment if one of the blocks should crack allowing sea water to communicate with the interior of the sea block.

The blocks could be manufactured at a construction facility located near the coastline where erosion is a problem, or they could be transported long distances by barge and set in place using a crane at its position upon the barge. Crane barges or derrick barges are commonly used by a number of offshore construction companies and are known in the art.

Each block would be formed and poured, allowed to cure, lined if desired, and then filled with the refuse material. The material could be compacted, if desired, and then each block sealed by pouring concrete over the top of the material. The sealing of the material could be accomplished at the erosion site or at the construction facility depending upon lifting capabilities for movement of the blocks. The method thus provides a means to readily form a break water or barrier to wave action in any geometric configuration that would be particularly useful in a given situation. The blocks are massive and of structural load carrying reinforced concrete, and because they can be filled with heavy refuse material, they have a potential of weighing massive amounts, and thus little or no susceptibility to movement during storms such as hurricanes.

The blocks may advantageously include scour-reduction means, such as a ledge or ring around the perimeter thereof.

BRIEF DESCRIPTION OF THE DRAWINGS

A better understanding of the invention can be had when the detailed description of a preferred embodiment set forth below is considered in conjunction with the drawings, in which.

LIST OF ELEMENTS

Figure 1:
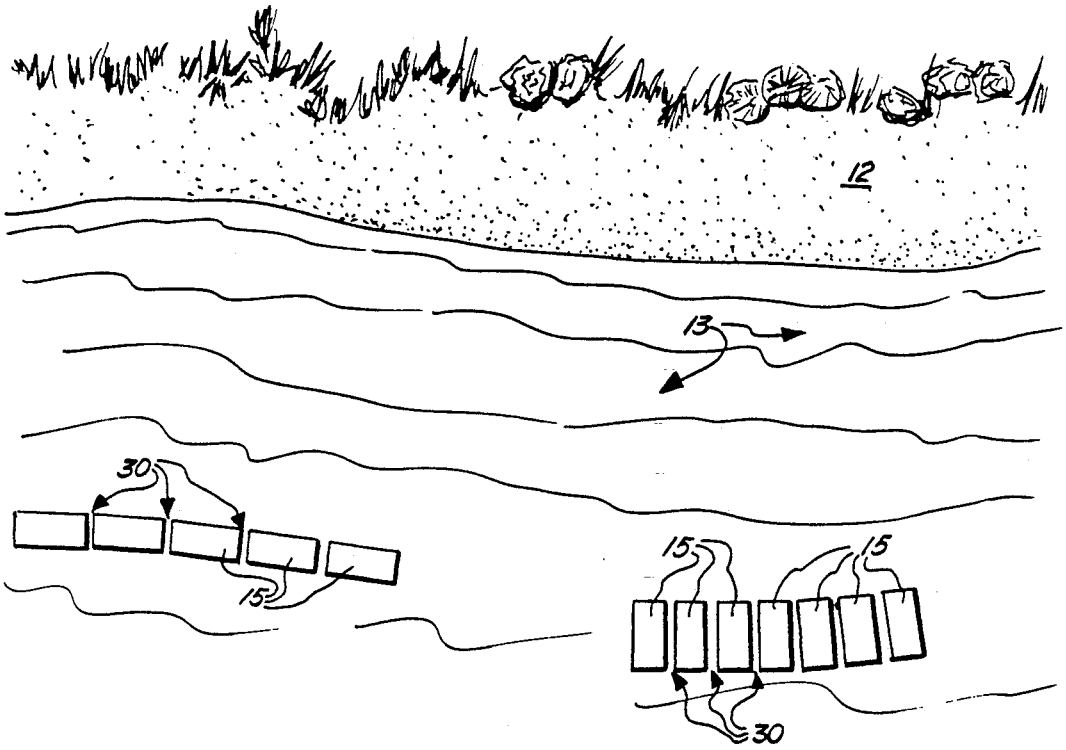
FIG. 1 is a top plan schematic view of the preferred embodiment of the apparatus of the present invention showing placement of the sea blocks along a coastal erosion zone.

10 apparatus of the preferred embodiment
12 land zone area
13 sea
14 sea bed
15 sea blocks
16 interior space of block 15
17 concrete side wall of block 15
18 concrete side wall of block 15
19 concrete side wall of block 15
20 concrete side wall of block 15
21 bottom of block 15
25 reinforcing steel rods
26 recess for lifting eye 27 in wall of block 35
27 lifting eye
29 lid of block 15
35 concrete block
36 concrete ring of block 35
45 concrete block
46 concrete toe protection ledge of block 45

DETAILED DESCRIPTION OF THE PREFERRED EMBODIMENT

Figure 1A:
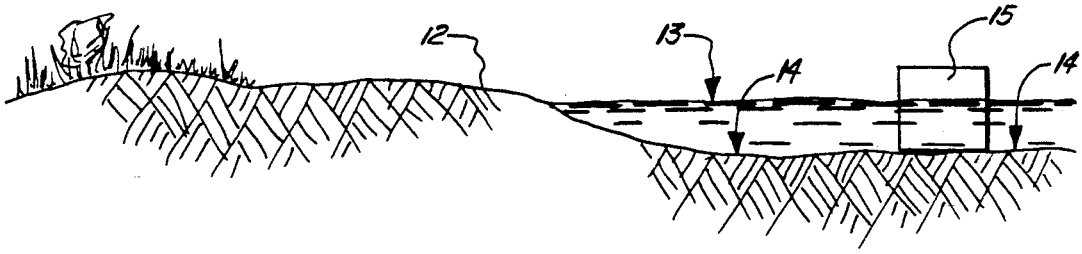
FIG. 1A is a schematic side elevational view illustrating placement of a sea block at a coastal erosion zone.
Figure 2:
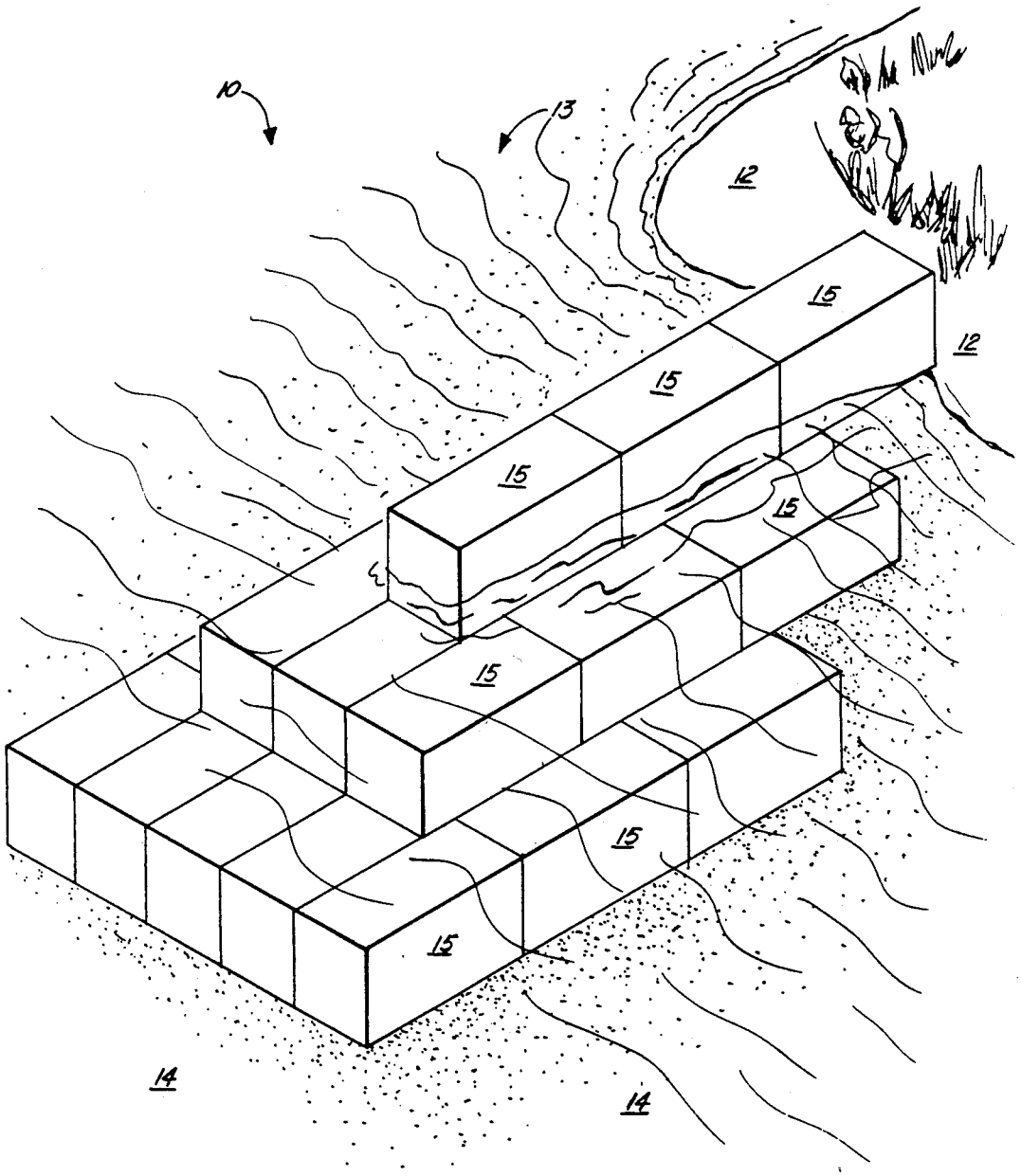
FIG. 2 is a perspective view of the sea block system of the present invention shown in a construction of a jetty in deeper water.
Figure 3:
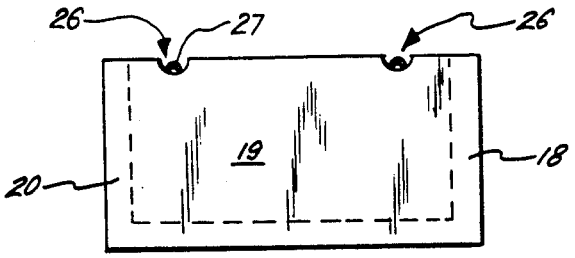
FIG. 3 is an elevational view of the preferred embodiment of the apparatus of the present invention.
Figure 4:
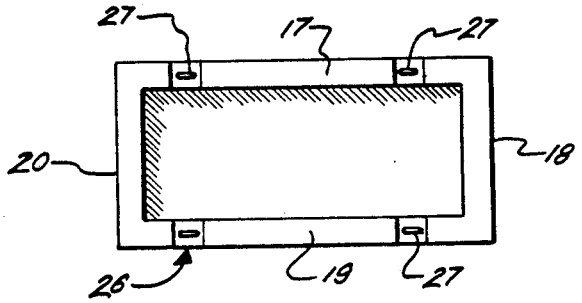
FIG. 4 is a top view of the preferred embodiment of the apparatus of the present invention.
Figure 5:
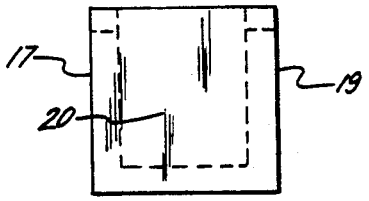
FIG. 5 is an end view of the preferred embodiment of the apparatus of the present invention.
Figure 6:
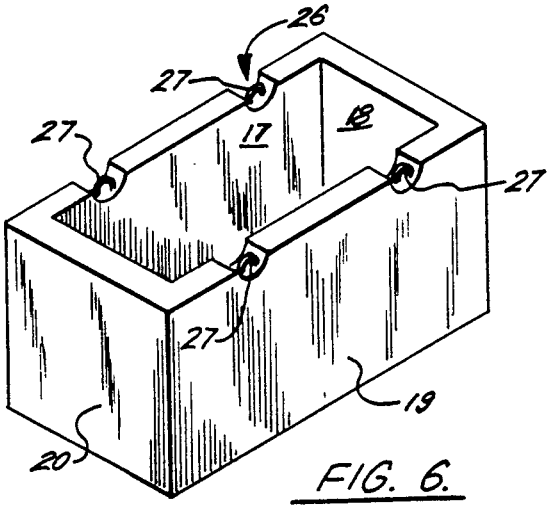
FIG. 6 is a perspective view of the preferred embodiment of the apparatus of the present invention.

FIGS. 1, 1A and 2 show generally the preferred embodiment of the apparatus of the present invention designated generally by the numeral 10 with a plurality of sea blocks 15 being shown in various geometric configurations. It should be understood that the present invention provides a wave control break water or coastal stabilization system that comprises a plurality of erosion control massive blocks which can be arranged in any number of geometric patterns. The top plan view of FIG. 1 is exemplary of an elongated array of blocks 15 including five blocks 15 which are positioned end-to-end with spaces 30 therebetween and seven blocks positioned side-by-side with spaces 30 therebetween to provide a much more substantial barrier to wind and wave action.

In FIG. 1, the land zone area is designated by the numeral 12, while the sea is designated generally by the numeral 13. In FIG. 1A, a side view illustrates placement of a single block 15 in water upon the sea bed 14 and spaced a distance from the land 12. In this manner, blocks 15 could be arranged in a break water or erosion control array several hundred feet from the seashore in water, for example, five-eight feet (5'-8') deep. Then sediment material, such as sand, could be added in that space shown in FIG. 1A between land mass 12 and the blocks 15. Because the blocks are readily transportable using a derrick barge, crane barge or the like, they could then be moved outwardly and more sand or sediment material added between the blocks and the land zone.

Thus, the present invention provides a very flexible versatile method and apparatus for controlling erosion in that the blocks 15 can be formed into a variety of designs for different environments and for different erosion control problems. Because the blocks are readily transportable and structurally very strong and massive, they could be reused indefinitely if constructed properly at different sites and locations over a long period of time.

In FIG. 2 a perspective view illustrates a jetty formed of a plurality of blocks 15. Notice that the underlying layer of blocks extends along the sea bed five blocks wide and three blocks deep. A second layer of blocks 15 is stacked upon the first layer and includes an array of blocks three blocks wide and three blocks deep, while the uppermost layer includes three blocks stacked end-to-end, as shown in the drawing. Thus, the blocks are stackable so that they can be used even in deeper water, that is, water that is deeper than the height of a particular block. Because the blocks are flat on top and bottom surfaces and can be stacked, the present invention would have utility in the construction of very long jetties and piers, in that persons could walk on the top surface of blocks 15 forming the jetties, and in some installations, automobiles could drive on the top of the blocks if they were arranged on a tightly packed jetty construction and then covered with a road surface, such as bituminous materials such as asphalt, concrete or the like.

Figure 7:
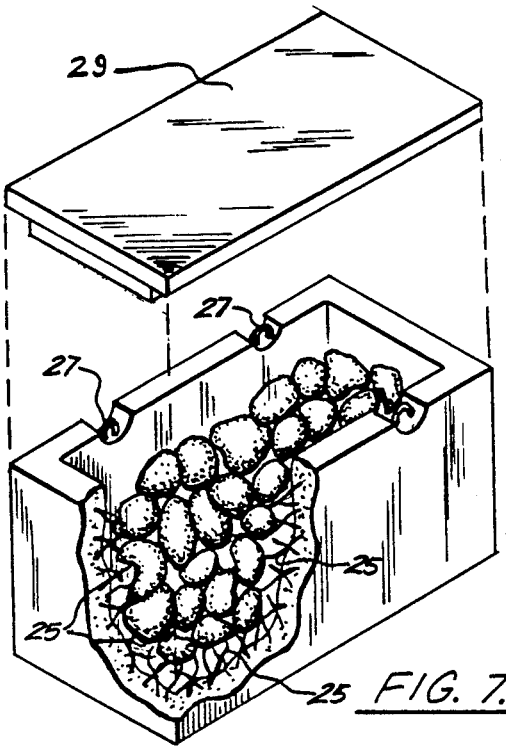
FIG. 7 is a perspective cut-away view of the preferred embodiment of the apparatus of the present invention.

FIGS. 3-7 show more particularly the construction of the preferred embodiment of the apparatus of the present invention. In FIGS. 3-7, each block 15 is shown as comprising a plurality of concrete side walls 17-20 defining in combination with bottom 21 an interior space 16. Reinforcing steel would be included within all of the walls 17–21. In FIG. 7, reinforcing steel is designated generally by the numeral 25. A plurality of lifting eyes 27 are provided, preferably four, each lifting eye 27 being recessed within recess 26 so that the lifting eye 27 does not interfere with stacking of a number of blocks upon one another. An uppermost lid 29 would be used to seal the blocks, as shown in FIG. 7, or alternatively, the blocks would be sealed with liquid concrete and then the liquid concrete cover would be allowed to cure before use of the blocks.

In the preferred embodiment, the reinforcing rods 25 includes half inch (½") diameter steel rods spaced 12 inches (12") on center both ways.

Figure 8:
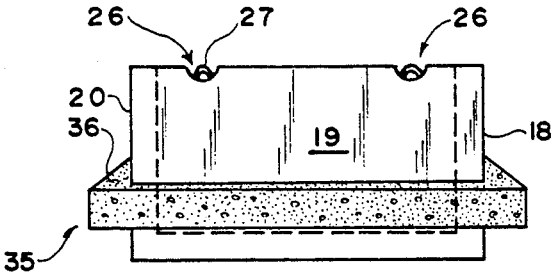
FIG. 8 is an elevational view of an alternative embodiment of the apparatus of the present invention.
Figure 9:
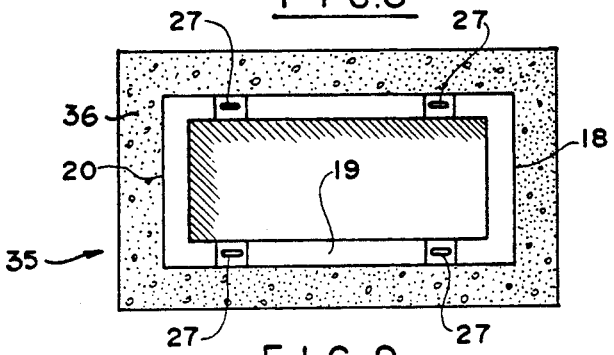
FIG. 9 is a top view of the embodiment of FIG. 8.
Figure 10:
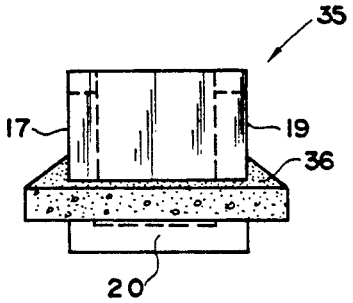
FIG. 10 is an end view of the embodiment of FIG. 8.

FIGS. 8–10 show an alternative embodiment of the apparatus of the present invention, block 35. Block 35 is similar to block 15, but in addition it has an external rectangular concrete ring 36 intermediate the top and bottom thereof, and preferably intermediate the middle and bottom thereof. Ring 36 is preferably integral with block walls 17–20.

Figure 11:
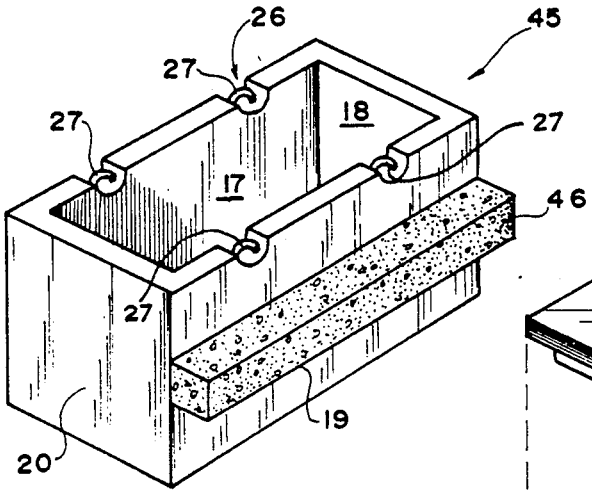
FIG. 11 is a perspective view of another alternative embodiment of the apparatus of the present invention.
Figure 12:
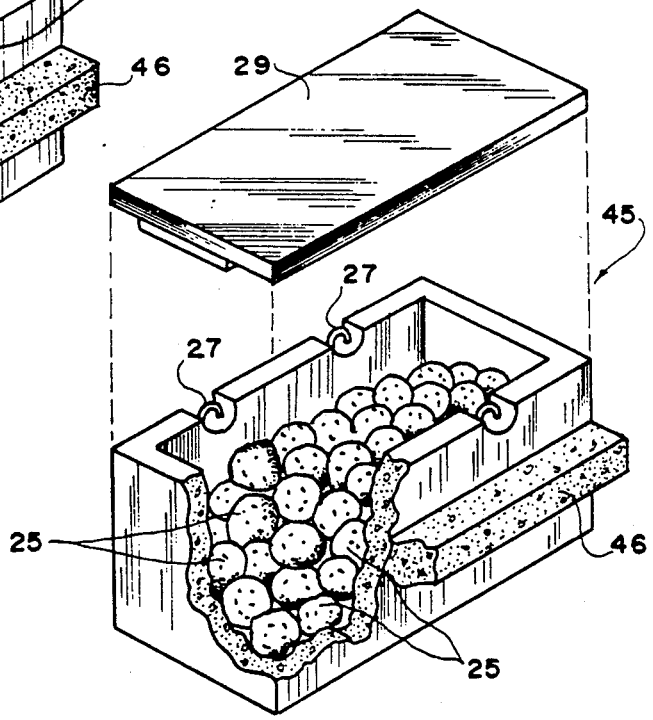
FIG. 12 is a perspective cut-away view of the alternative embodiment of the apparatus of the present invention shown in FIG. 11.

FIGS. 11 and 12 illustrate another alternative embodiment of the apparatus of the present invention, concrete block 45. Concrete block 45 includes a concrete toe protection ledge 46 on wall 19 thereof. Ledge 46 is intermediate the top and bottom of wall 19, and preferably intermediate the middle and bottom thereof. Ledge 46 is preferably integral with block wall 19.

Ring 36 and ledge 46 serve several purposes, including reducing scouring under blocks 35 and 45, reducing sinking of blocks 35 and 45, and providing spacing between blocks.

Ring 35 and ledge 46 help to reduce scouring under the blocks by directing wave energy backward rather than allowing it to travel downward along the walls of the blocks. When block 45 is being used, wall 19 is placed perpendicular to the prevailing direction of the wave and on the side of block 45 from which the waves come. Ring 36 is advantageous over ledge 45 in that it prevents scouring under block 35 regardless of the direction from which the waves come, and thus block 35 would be preferred over block 45 for use in areas where the direction of the waves is not substantially constant.

Ring 36 and ledge 46 help prevent sinking of blocks 35 and 45 by increasing the area of the base of the blocks. Ring 36 also helps to prevent uneven settling of block 35.

Ring 36 and ledge 46 also act as spacers to control the gap between blocks.

The foregoing description of the invention is illustrative and explanatory thereof, and various changes in the size, shape and materials, as well as in the details of the illustrated construction may be made without departing from the spirit of the invention.

What is claimed as invention is:

1. A method of coastal erosion control comprising the steps of:

a) transporting a plurality of massive and transportable hollow concretious blocks of concrete to a coastal site where erosion is to be controlled;

b) arranging the massive blocks in an array that extends along the erosion site so that the blocks can dissipate wave action;

c) filling the hollow blocks with fill material until each of the blocks has a weight of at least twenty five (25) tons; and d) sealing each block after the fill material is added so that wave action cannot scatter the fill material during heavy seas.

2. The method of claim 1 wherein each block has an upper and lower flattened surface area so that a plurality of blocks can be stacked upon each other.

3. The method of claim wherein in step "b" the blocks are spaced apart so that water can flow between the blocks.

4. The method of claim 1 wherein the blocks have minimal dimensions of fourteen feet (14') long, eight feet (8') high, and six feet (6') wide.

5. Apparatus for controlling coastal erosion comprising:

a) a plurality of massive hollow, transportable concrete blocks, each block including four continuous connected side walls and a bottom wall defining a sealed interior;

b) scour-reduction means for reducing scouring beneath the blocks when the blocks are installed in a coastal zone to control erosion; and c) means for closing the top of the blocks to form a sealed interior after fill material has been added to the block interior, the blocks being arranged in an array to form a geometric pattern of blocks along a coastal zone where erosion is to be controlled, and in a position spaced from the shoreline so that wave action is dissipated before it reaches the shoreline.

6. The apparatus of claim 5, wherein:

the scour-reduction means comprises a ledge projecting outwardly from one of the walls of each block.

7. The apparatus of claim 5, further comprising:

lifting eye means spaced around the periphery of each block.

8. The apparatus of claim 5, wherein:

the scour-reduction means comprises a ledge integral with one of the walls of each block and projecting outwardly therefrom.

9. The apparatus of claim 5, wherein:

the scour-reduction means comprises a ring projecting outwardly from the walls of each block.

10. The apparatus of claim 5, wherein:

the scour-reduction means comprises a plurality of rings, each block having a ring integral with the wall thereof and projecting outwardly therefrom.

11. The apparatus of claim 5 wherein each block has an upper and lower flattened surface area so that a plurality of blocks can be stacked upon each other.

12. The apparatus of claim 5 wherein the blocks are spaced apart so that water can flow between the blocks.

13. The apparatus of claim 5 wherein the blocks have minimal dimensions of fourteen feet (14') long, eight feet (8') high, and six feet (6') wide.

14. An apparatus for controlling coastal erosion comprising:

a) a massive hollow, transportable concrete block including four continuous connected side walls and a bottom wall defining a sealed interior;

b) scour-reduction means for reducing scouring beneath the block when the block is installed in a coastal zone to control erosion; and c) means for closing the top of the block to form a sealed interior after fill material has been added to the block interior.

15. The apparatus of claim 14, wherein:

the scour-reduction means comprises a ledge projecting outwardly from one of the walls of the block.

16. The apparatus of claim 14, wherein:

the scour-reduction means comprises a ledge integral with one of the walls of the block and projecting outwardly therefrom.

17. The apparatus of claim 14, wherein:

the scour-reduction means comprises a ring projecting outwardly from the walls of the block.

18. The apparatus of claim 14, wherein:

the scour-reduction means comprises a ring integral with the walls of the block and projecting outwardly therefrom.

19. The apparatus of claim 14, further comprising: lifting eye means spaced around the periphery of each block.

20. The apparatus of claim 14 wherein each block has an upper and lower flattened surface area so that a plurality of blocks can be stacked upon each other.

21. The apparatus of claim 14 wherein the blocks have minimal dimensions of fourteen feet (14') long, eight feet (8') high, and six feet (6') wide.

* * * * *